US010056710B1

(12) United States Patent
Yang

(10) Patent No.: US 10,056,710 B1
(45) Date of Patent: Aug. 21, 2018

(54) TERMINAL MODULE AND ELECTRICAL CONNECTOR COMPRISING THE SAME

(71) Applicant: ALL BEST PRECISION TECHNOLOGY CO., LTD., Taoyuan (TW)

(72) Inventor: Haven Yang, New Taipei (TW)

(73) Assignee: ALL BEST PRECISION TECHNOLOGY CO., LTD. (TW)

( * ) Notice: Subject to any disclaimer, the term of this patent is extended or adjusted under 35 U.S.C. 154(b) by 0 days.

(21) Appl. No.: 15/787,091

(22) Filed: Oct. 18, 2017

(51) Int. Cl.

| | |
|---|---|
| ***H01R 13/514*** | (2006.01) |
| ***H01R 13/502*** | (2006.01) |
| ***H01R 12/50*** | (2011.01) |
| ***H01R 12/71*** | (2011.01) |
| ***H01R 24/66*** | (2011.01) |
| ***H01R 24/28*** | (2011.01) |
| ***H01R 43/24*** | (2006.01) |

(52) U.S. Cl.
CPC ..... *H01R 13/514* (2013.01); *H01R 12/716* (2013.01); *H01R 13/502* (2013.01); *H01R 23/6873* (2013.01); *H01R 24/28* (2013.01); *H01R 24/66* (2013.01); *H01R 43/24* (2013.01)

(58) Field of Classification Search
CPC ..... H01R 13/514; H01R 43/24
See application file for complete search history.

(56) References Cited

U.S. PATENT DOCUMENTS

| | | | | |
|---|---|---|---|---|
| 9,337,585 | B1 * | 5/2016 | Yang | H01R 13/6583 |
| 2012/0058686 | A1 * | 3/2012 | Zhang | H01R 24/64 439/660 |
| 2015/0093939 | A1 * | 4/2015 | Yang | H01R 9/24 439/626 |
| 2016/0079691 | A1 * | 3/2016 | Yang | H01R 12/57 439/676 |

* cited by examiner

*Primary Examiner* — James Harvey
(74) *Attorney, Agent, or Firm* — Schmeiser, Olsen & Watts, LLP

(57) ABSTRACT

A terminal module comprises a first terminal-module having a first base, first terminal-unit and first receiving recesses; a second terminal-module having a second base and second terminal-unit; a third terminal-module having a third base and third terminal-unit; and a fourth terminal-module having a fourth base, fourth terminal-unit and second receiving recesses. The first, second, third and fourth bases are coupled to the first, second, third and fourth terminal-units by injection molding, respectively. The fourth terminal-unit corresponds in position to the first terminal-unit. The second terminal-unit corresponds in position to the third terminal-unit and lies behind the first and fourth terminal-units. A ground terminal and two signal terminals are disposed at at least one side of the first, second, third and/or fourth terminal-units. The ground terminal is the outermost one. An electrical connector comprises a casing and the terminal module disposed therein.

19 Claims, 6 Drawing Sheets

TERMINAL MODULE AND ELECTRICAL CONNECTOR COMPRISING THE SAME

FIELD OF THE INVENTION

The present invention relates to terminal modules and electrical connectors comprising the terminal modules and, more particularly, to a terminal module and an electrical connector comprising the terminal module, which involve using an electronic plug-in plate.

BACKGROUND OF THE INVENTION

A conventional electrical connector which an electronic plug-in plate is plugged in usually comprises a casing, four terminal units and at least four supports. The terminal units are arranged in upper and lower rows and disposed on the supports. Afterward, the supports which hold the terminal units are sequentially disposed in the casing to finalize the assembly of the electrical connector.

To fit related electronic products, the conventional electrical connector has to be lightweight, thin, short and compact, and thus terminals of the terminal units have to be small. After the terminals of the terminal units have been mounted on the supports, the supports which hold the terminal units have to be placed one by one and sequentially inside the casing. As a result, the assembly process is accompanied by mutual interference between the terminal units, leading to the bending and even damaging of the terminals of the terminal units to the detriment of the yield and use of the electrical connector.

Accordingly, it is imperative to provide a terminal module and an electrical connector comprising the terminal module and thereby overcome the aforesaid drawbacks of the prior art.

SUMMARY OF THE INVENTION

In view of the aforesaid drawbacks of the prior art, the inventor of the present invention conceived room for improvement in the prior art and thus conducted extensive researches and experiments according to the inventor's years of experience in the related industry, and finally developed a terminal module and an electrical connector comprising the terminal module as disclosed in the present invention to enable quick assembly, ensure ease of manufacturing, and enhance yield.

In order to achieve the above and other objectives, the present invention provides a terminal module and an electrical connector comprising the terminal module. The terminal module comprises a first terminal module, a second terminal module, a third terminal module and a fourth terminal module. The first terminal module comprises a first base and a first terminal unit. The first base is coupled to the first terminal unit by injection molding. First receiving recesses are disposed at the top of the first base. The second terminal module comprises a second base and a second terminal unit. The second base is coupled to the second terminal unit by injection molding. The second terminal unit has a contacting end received in the first receiving recesses. The third terminal module comprises a third base and a third terminal unit. The third base is coupled to the third terminal unit by injection molding. The third terminal unit and the second terminal unit correspond in position to each other. The fourth terminal module comprises a fourth base and a fourth terminal unit. The fourth base is coupled to the fourth terminal unit by injection molding. Second receiving recesses for receiving a contacting end of the third terminal unit are disposed at the bottom of the fourth base. The fourth terminal unit and the first terminal unit correspond in position to each other. The second terminal unit and the third terminal unit are behind the first terminal unit and the fourth terminal unit. A ground terminal, a signal terminal and a signal terminal are disposed at at least one side of at least one of the first terminal unit, the second terminal unit, the third terminal unit and the fourth terminal unit, with the ground terminal being outermost.

Regarding the terminal module, two first adjoining portions are disposed at two sides of a top of the first base, respectively, and coupled to a bottom of the second base.

Regarding the terminal module, the first terminal unit comprises first terminals each having a body portion with two ends provided with a contacting end and a connecting end, respectively, the first base enclosing the body portions of the first terminals.

Regarding the terminal module, the first terminal module further comprises a first ground element coupled to the first base so that extending portions are disposed at an edge of the first ground element and are in contact with the ground terminal of the first terminal unit.

Regarding the terminal module, two second adjoining portions are disposed at two sides of a bottom of the second base, respectively, and coupled to a top of the first base, whereas two second engaging portions are disposed at two sides of the top of the second base, respectively, and coupled to a bottom of the third base.

Regarding the terminal module, the second terminal unit comprises second terminals each having a body portion with two ends provided with the contacting end and a connecting end, respectively, the second base enclosing the body portions of the second terminals.

Regarding the terminal module, the second base has a hollow-cored region from which the body portions of the second terminals are fully exposed.

Regarding the terminal module, two third adjoining portions are disposed at two sides of a bottom of the third base, respectively, and coupled to a top of the second base, whereas two third engaging portions are disposed at two sides of a top of the third base, respectively, and coupled to a bottom of the fourth base.

Regarding the terminal module, the third terminal unit comprises third terminals each having a body portion with two ends provided with the contacting end and a connecting end, respectively, the third base enclosing the body portions of the third terminals.

Regarding the terminal module, the third base has a hollow-cored region from which the body portions of the third terminals are fully exposed.

Regarding the terminal module, two fourth adjoining portions are disposed at two sides of a bottom of the fourth base, respectively, and coupled to a top of the third base.

Regarding the terminal module, the fourth terminal unit comprises fourth terminals each having a body portion with two ends provided with a contacting end and a connecting end, respectively, the fourth base enclosing the body portions of the fourth terminals.

Regarding the terminal module, the fourth terminal module further comprises a fourth ground element coupled to the fourth base so that extending portions are disposed at an edge of the fourth ground element and are in contact with the ground terminal of the fourth terminal unit.

The present invention further provides an electrical connector which comprises the terminal module and a casing. The terminal module is disposed in the casing.

Regarding the electrical connector, the casing comprises a housing and a rear lid. The housing contains the terminal module. The rear lid and the housing are coupled together to confine the terminal module to the housing.

Regarding the electrical connector, the housing has a receiving region containing the terminal module and has an end provided with a mouth and grooves in communication with the mouth, the grooves receiving contacting ends of the first terminals and contacting ends of the fourth terminals, and an opening in communication with the receiving region is disposed at a bottom of the housing, allowing the connecting ends of the first terminals, the connecting ends of the second terminals, the connecting ends of the third terminals, and the connecting ends of the fourth terminals to be disposed at the opening.

Regarding the electrical connector, channels are disposed on inner sides of two opposing sidewalls of the housing, and two fixing holes penetrate the two opposing sidewalls of the housing to communicate with the channels, respectively, with the rear lid comprising a baffle and two lateral plates flanking the baffle, wherein guide portions and hook portions are disposed on the lateral plates, respectively, with the rear lid coupled to the housing, allowing the channels to receive the guide portions and the hook portions, with the hook portions engaged with the fixing holes.

Regarding the electrical connector, the baffle has limiting notches, with the rear lid coupled to the housing, allowing the limiting notches to constrain the connecting ends of the fourth terminals.

Regarding the electrical connector, two opposing through holes are disposed on two sidewalls of the housing and positioned proximate to the opening, respectively, with a supporting plate insertedly disposed at each said through hole, allowing the connecting ends of the first terminals, the connecting ends of the second terminals, the connecting ends of the third terminals, and the connecting ends of the fourth terminals to press against the supporting plates.

A terminal module and an electrical connector comprising the terminal module according to the present invention are characterized in that a first terminal module, second terminal module, third terminal module and fourth terminal module are integrated to form a terminal module, and then the terminal module is placed inside the casing to form the electrical connector, so as to enable quick assembly, ensure ease of manufacturing, and enhance yield.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
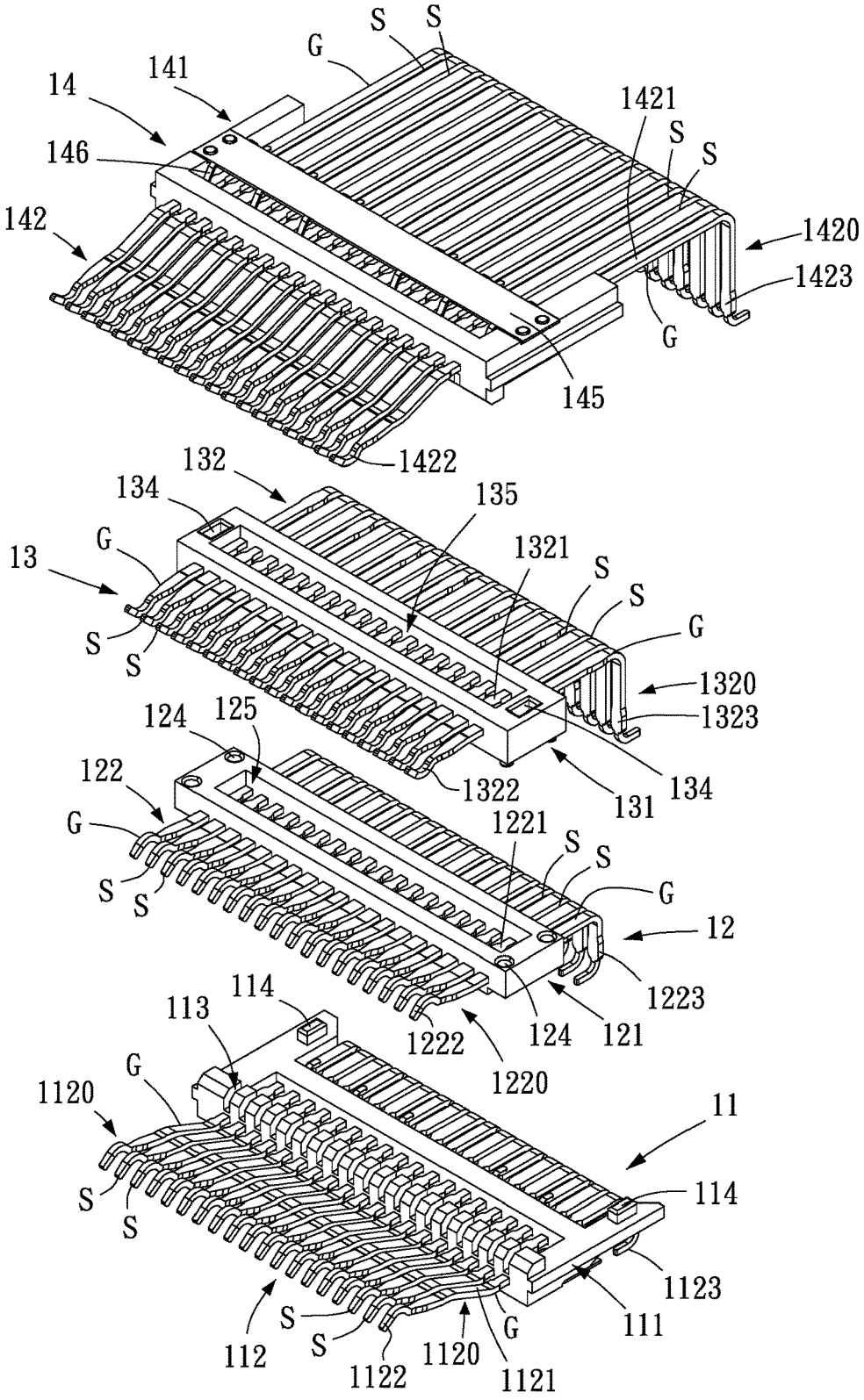
FIG. 1 is an exploded view of a terminal module according to a preferred embodiment of the present invention.
Figure 2:
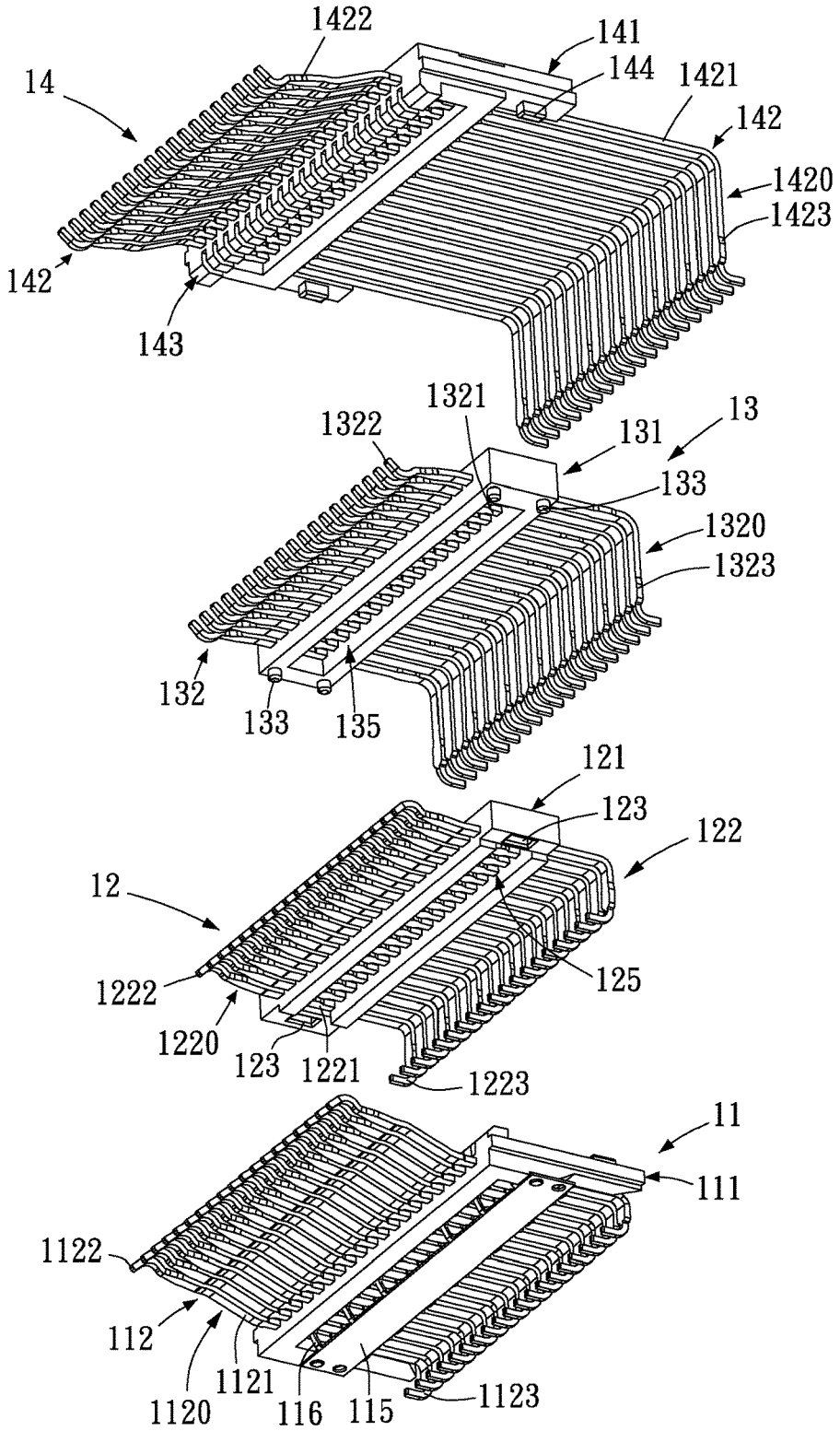
FIG. 2 is another exploded view of the terminal module according to the preferred embodiment of the present invention.
Figure 3:
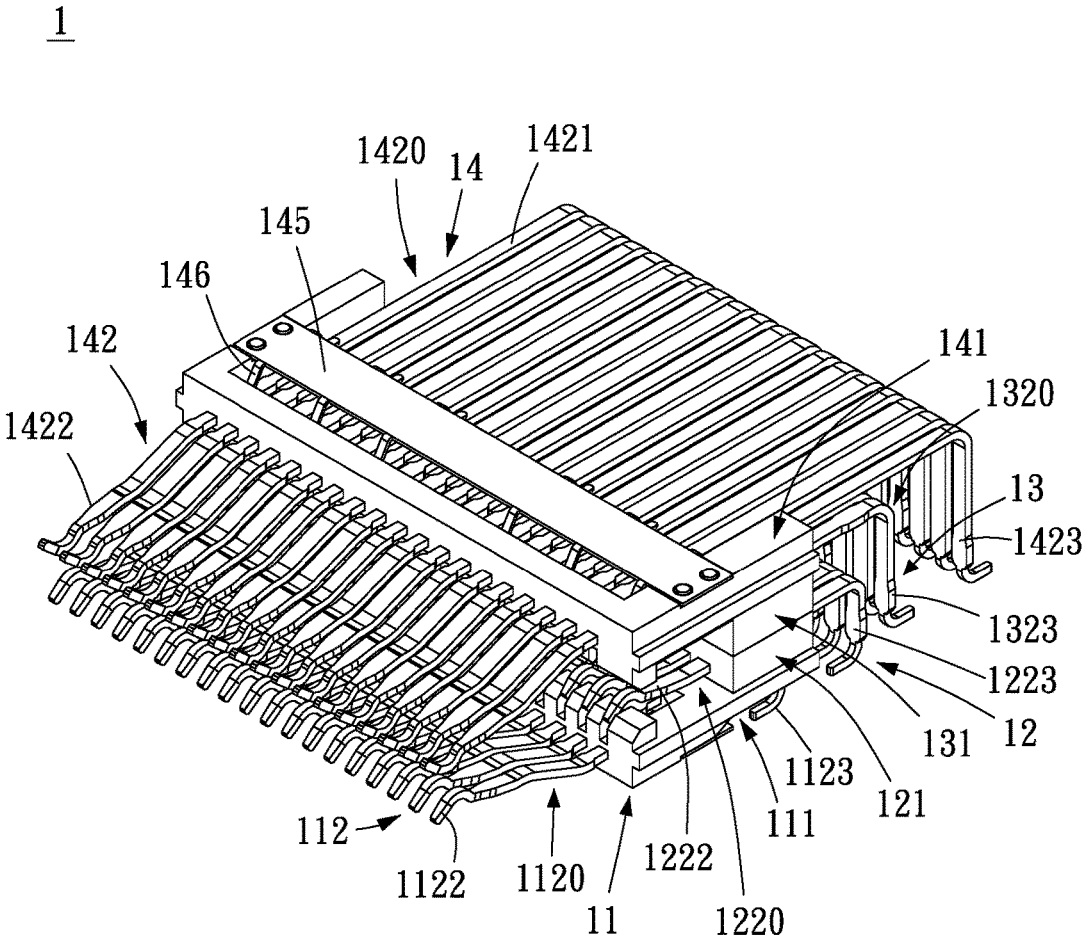
FIG. 3 is a perspective view of the terminal module according to the preferred embodiment of the present invention.

Referring to FIG. 1 through FIG. 3, the present invention provides a terminal module and an electrical connector comprising the terminal module. The terminal module and an electrical connector comprising the terminal module. The terminal module 1 comprises a first terminal module 11, a second terminal module 12, a third terminal module 13 and a fourth terminal module 14.

The first terminal module 11 comprises a first base 111 and a first terminal unit 112. The first base 111 is coupled to the first terminal unit 112 by injection molding. First receiving recesses 113 are disposed on the top of the first base 111.

The second terminal module 12 comprises a second base 121 and a second terminal unit 122. The second base 121 is coupled to the second terminal unit 122 by injection molding. The second base 121 and the first base 111 are combined. The first terminal module 11 and the second terminal module 12 are combined by whatever means. A contacting end 1222 of the second terminal unit 122 is received in the first receiving recesses 113.

The third terminal module 13 comprises a third base 131 and a third terminal unit 132. The third base 131 is coupled to the third terminal unit 132 by injection molding. The third base 131 and the second base 121 are combined. The third terminal module 13 and the second terminal module 12 are combined by whatever means. The third terminal unit 132 and the second terminal unit 122 correspond in position to each other so as to be in electrical contact with an electronic plug-in plate.

The fourth terminal module 14 comprises a fourth base 141 and a fourth terminal unit 142. The fourth base 141 is coupled to the fourth terminal unit 142 by injection molding. Second receiving recesses 143 are disposed on the bottom of the fourth base 141 to receive a contacting end 1322 of the third terminal unit 132. The fourth base 141 and the third base 131 are combined. The fourth terminal module 14 and the third terminal module 13 are combined by whatever means. The fourth terminal unit 142 and the first terminal unit 112 correspond in position to each other so as to be in electrical contact with the electronic plug-in plate. The second terminal unit 122 and the third terminal unit 132 are disposed between the first terminal unit 112 and the fourth terminal unit 142. The contacting end 1222 of the second terminal unit 122 and the contacting end 1322 of the third terminal unit 132 are disposed behind a contacting end 1122 of the first terminal unit 112 and a contacting end 1422 of the fourth terminal unit 142.

A ground terminal G, a signal terminal S and a signal terminal S are disposed at the left side, right side, or left and right sides of at least one of the first terminal unit 112, the second terminal unit 122, the third terminal unit 132 and the fourth terminal unit 142, with the ground terminal(s) G being the outermost one(s). Therefore, the terminal module of the present invention is applicable to QSFP-DD electrical connector and SFP-DD electrical connector.

In a preferred embodiment of the present invention, the first terminal module 11 further comprises a first base 111. Two first adjoining portions 114 are disposed at two sides of the top of the first base 111, respectively. The first terminal unit 112 comprises first terminals 1120. The first terminals 1120 each have a body portion 1121. A contacting end 1122 and a connecting end 1123 are disposed at the two ends of the body portion 1121, respectively. The first base 11 encloses the body portions 1121 of the first terminals 1120. The first terminal module 11 further comprises a first ground element 115. The first ground element 115 and the first base 111 are coupled together so that the first ground element 115 is in contact with the ground terminal G of the first terminal unit 112. Extending portions 116 are disposed at the edge of the first ground element 115. The extending portions 116 are in contact with the body portions 1121 of the ground terminals G in the first terminals 1120.

In a preferred embodiment of the present invention, two second adjoining portions 123 are disposed at two sides of the bottom of the second base 121 of the second terminal module 12, respectively, whereas two second engaging portions 124 are disposed at two sides of the top of the second base 121, respectively, with the second terminal unit 122 comprising second terminals 1220. The second terminals 1220 each have a body portion 1221. The contacting end 1222 and a connecting end 1223 are disposed at the two ends of the body portion 1221, respectively. The second base 121 encloses the body portions 1221 of the second terminals 1220. The second base 121 has a hollow-cored region 125. The body portions 1221 of the second terminals 1220 are fully exposed from the hollow-cored region 125.

In a preferred embodiment of the present invention, the third terminal module 13 further comprises a third base 131. Two third adjoining portions 133 are disposed at two sides of the bottom of the third base 131, respectively, whereas two third engaging portions 134 are disposed at two sides of the top of the third base 131, respectively, with the third terminal unit 132 comprising third terminals 1320. The third terminals 1320 each have a body portion 1321. The contacting end 1322 and a connecting end 1323 are disposed at the two ends of the body portion 1321, respectively. The third base 131 encloses the body portions 1321 of the third terminals 1320. The third base 131 has a hollow-cored region 135. The body portions 1321 of the third terminals 1320 are fully exposed from the hollow-cored region 135.

In an embodiment of the present invention, the fourth terminal module 14 further comprises a fourth base 141. Two fourth adjoining portions 144 are disposed at two sides of the bottom of the fourth base 141, respectively. The fourth terminal unit 142 comprises fourth terminals 1420. The fourth terminals 1420 each have a body portion 1421. A contacting end 1422 and a connecting end 1423 are disposed at the two ends of the body portion 1421, respectively. The fourth base 141 encloses the body portions 1421 of the fourth terminals 1420. The fourth terminal module 14 further comprises a fourth ground element 145. The fourth ground element 145 is coupled to the fourth base 141 so that the fourth ground element 145 is in contact with the ground terminal G of the fourth terminal unit 142. Extending portions 146 are disposed at the edge of the fourth ground element 145. The extending portions 146 are in contact with the body portions 1421 of the ground terminals G in the fourth terminals 1420.

Assembly of the terminal module 1 comprises the steps of: fastening the second adjoining portions 123 at the bottom of the second base 121 of the second terminal module 12 to the first adjoining portions 114 at the top of the first base 111 so as to couple the second base 121 and the first base 111 together, allowing the contacting ends 1222 at ends of the second terminals 1220 to be received in the first receiving recesses 113, fastening the third adjoining portions 133 at the bottom of the third base 131 of the third terminal module 13 to the second engaging portions 124 at the top of the second base 121 of the second terminal module 12 so as to couple the third base 131 and the second base 121 together, fastening the fourth adjoining portions 144 at the bottom of the fourth base 141 of the fourth terminal module 14 to the third engaging portion 134 at the top of the third base 131 so as to couple the fourth base 141 and the third base 131 together, and allowing the contacting ends 1422 at ends of the fourth terminals 1420 to be received in the second receiving recesses 143. According to the present invention, the first adjoining portions 114, the second adjoining portions 123, the second engaging portions 124, the third adjoining portions 133, the third engaging portions 134, the fourth adjoining portions 144 are recesses, through holes, bumps or posts which match.

The second base 121 and the third base 131 are coupled to the second terminal unit 122 and the third terminal unit 132 by injection molding, respectively, so that parts of the body portions 1221, 1321 of the second terminals 1220 and the third terminals 1320 are fully exposed from the hollow-cored regions 125, 135, respectively, without being enclosed by the second base 121 and the third base 131, thereby reducing signal loss which might otherwise be incurred by the second terminal unit 122 and the third terminal unit 132. Furthermore, when the appearance of the second base 121 and the third base 131 remains unchanged, the sizes of the hollow-cored regions 125, 135 can be altered so as to change the exposed lengths of the body portions 1221, 1321 in the hollow-cored regions 125, 135, thereby changing the impedance of the second terminal unit 122 and the third terminal unit 132 to a specific level. Advantages of the present invention, such as structural simplification of dies for use in a manufacturing process, extended service life of the dies, the speedy manufacturing process, and the simple manufacturing process, are achievable, because the body portions 1221, 1321 in the hollow-cored regions 125, 135 of the second base 121 and the third base 131 are fully exposed, respectively.

Figure 4:
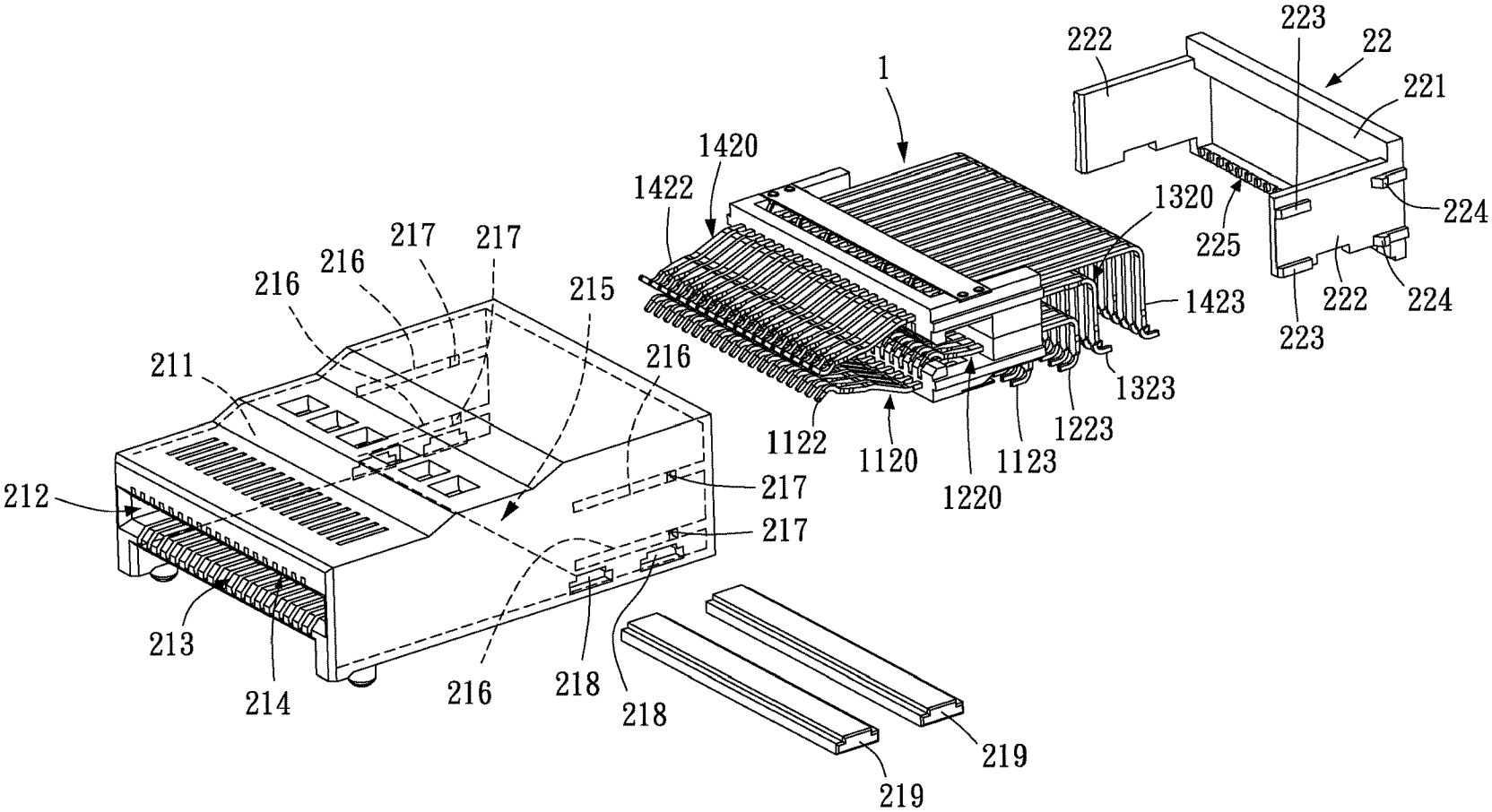
FIG. 4 is an exploded view of an electrical connector according to the preferred embodiment of the present invention.
Figure 5:
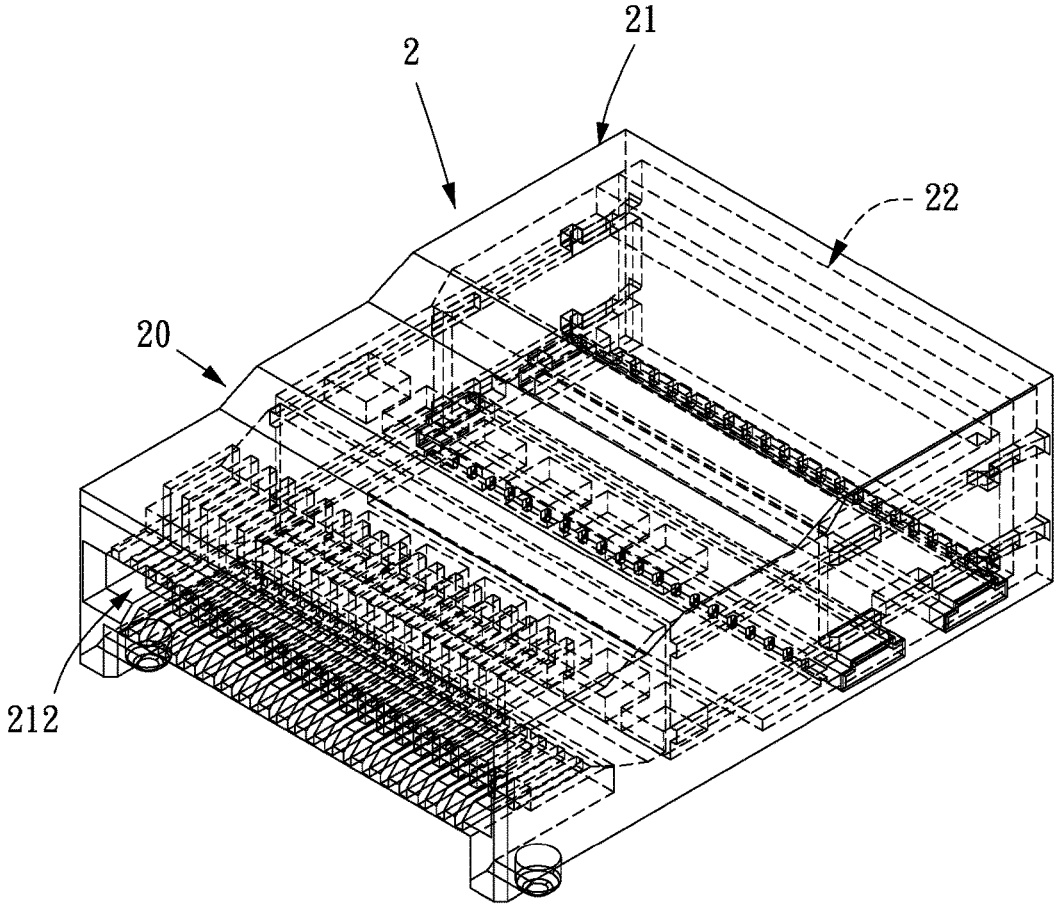
FIG. 5 is a perspective view of the electrical connector according to the preferred embodiment of the present invention.
Figure 6:
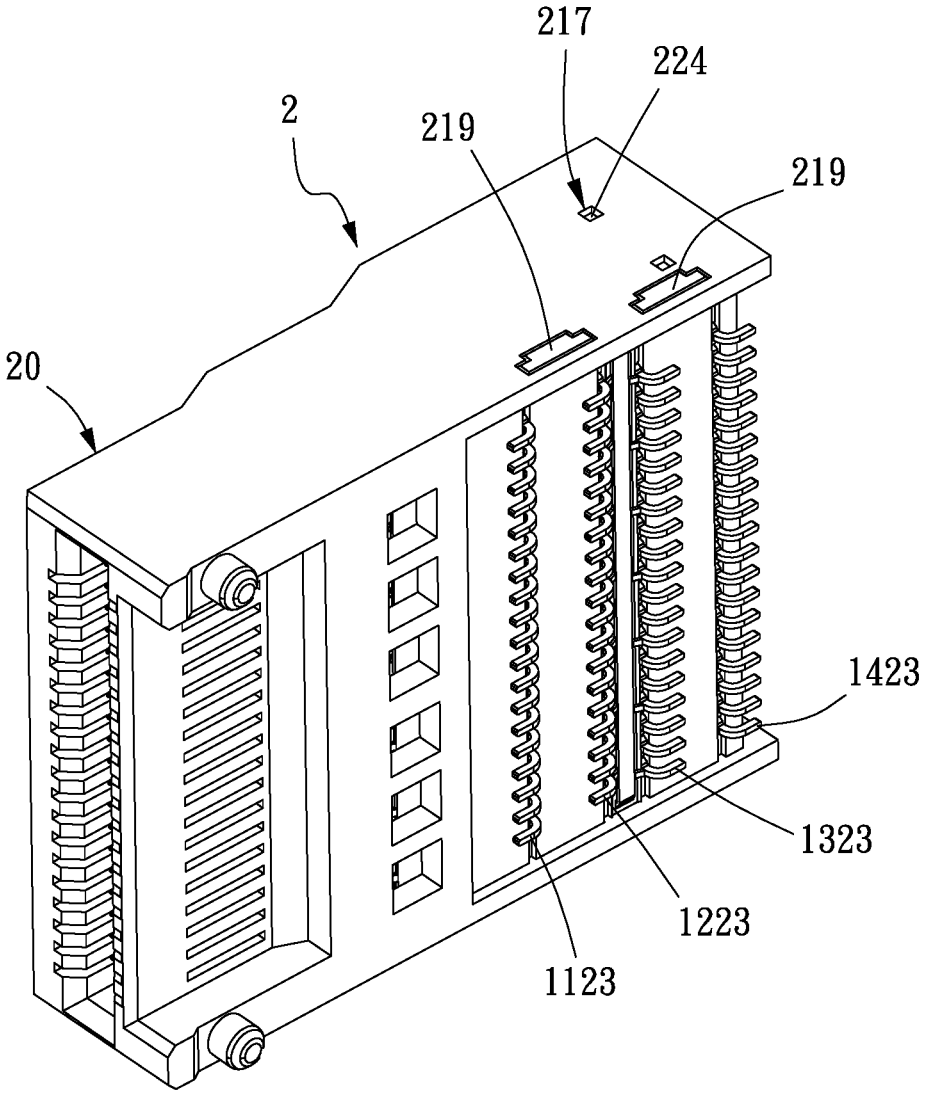
FIG. 6 is another perspective view of the electrical connector according to the preferred embodiment of the present invention.

Referring to FIG. 4 through FIG. 6, an electrical connector 2 of the present invention comprises a terminal module 1 and a casing 20. The terminal module 1 is disposed in the casing 20. The casing 20 comprises a housing 21 and a rear lid 22. The housing 21 contains the terminal module 1. The rear lid 22 and the housing 21 are coupled together to confine the terminal module 1 to the housing 21.

In a preferred embodiment of the present invention, the housing 21 has a receiving region 211. The receiving region 211 contains the terminal module 1. A mouth 212 is disposed at one end of the housing 21. Grooves 213, 214 in communication with the mouth 212 are disposed at the top and bottom at one end of the housing 21, respectively. The contacting ends 1122 of the first terminals 1120 and the contacting ends 1422 of the fourth terminals 1420 are received in the grooves 213, 214, respectively. An opening 215 in communication with the receiving region 211 is disposed at the bottom of the housing 21. The connecting ends 1123 of the first terminals 1120, the connecting ends 1223 of the second terminals 1220, the connecting ends 1323 of the third terminals 1320, and the connecting ends 1423 of the fourth terminals 1420 are disposed at the opening 215.

Channels 216 are disposed on the inner side of the left sidewall and the inner side of the right sidewall of the housing 21. Two fixing holes 217 penetrate the left sidewall and the right sidewall of the housing 21 to communicate with the channels 216, respectively. The rear lid 22 comprises a baffle 221 and two lateral plates 222 which flank the baffle 221. Guide portions 223 and hook portions 224 are disposed at the lateral plates 222, respectively. When the rear lid 22 and the housing 21 are coupled together, the guide portions 223 and the hook portions 224 are placed in the channels 216 so that the hook portions 224 are engaged with the fixing holes 217. Limiting notches 225 are disposed at the baffle 221. After the rear lid 22 and the housing 21 have been coupled together, the limiting notches 225 constrain the connecting ends 1423 of the fourth terminals 1420. Two through holes 218 penetrate the left sidewall and the right sidewall of the housing 21, respectively, and are positioned proximate to the opening 215. A supporting plate 219 is insertedly disposed at each said through hole 218. The connecting ends 1123 of the first terminals 1120, the connecting ends 1223 of the second terminals 1220, the connecting ends 1323 of the third terminals 1320, and the connecting ends 1423 of the fourth terminals 1420 press against the supporting plates 219. At this point in time, assembly of the electrical connector 2 is done.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A terminal module, comprising:

a first terminal module comprising a first terminal unit and a first base coupled to the first terminal unit by injection molding, with first receiving recesses disposed on a top of the first base;

a second terminal module comprising a second terminal unit and a second base coupled to the second terminal unit by injection molding, wherein a contacting end of the second terminal unit is received in the first receiving recesses;

a third terminal module comprising a third terminal unit and a third base coupled to the third terminal unit by injection molding, with the third terminal unit corresponding in position to the second terminal unit; and a fourth terminal module comprising a fourth terminal unit and a fourth base coupled to the fourth terminal unit by injection molding, with second receiving recesses disposed on a bottom of the fourth base to receive a contacting end of the third terminal unit, with the fourth terminal unit corresponding in position to the first terminal unit, wherein the second terminal unit and the third terminal unit are disposed behind the first terminal unit and the fourth terminal unit, wherein a ground terminal, a signal terminal and a signal terminal are disposed at at least one side of at least one of the first terminal unit, the second terminal unit, the third terminal unit and the fourth terminal unit, with the ground terminal being outermost.

2. The terminal module of claim 1, wherein two first adjoining portions are disposed at two sides of a top of the first base, respectively, and coupled to a bottom of the second base.

3. The terminal module of claim 1, wherein the first terminal unit comprises first terminals each having a body portion with two ends provided with a contacting end and a connecting end, respectively, the first base enclosing the body portions of the first terminals.

4. The terminal module of claim 1, wherein the first terminal module further comprises a first ground element coupled to the first base so that extending portions are disposed at an edge of the first ground element and are in contact with the ground terminal of the first terminal unit.

5. The terminal module of claim 1, wherein two second adjoining portions are disposed at two sides of a bottom of the second base, respectively, and coupled to a top of the first base, whereas two second engaging portions are disposed at two sides of the top of the second base, respectively, and coupled to a bottom of the third base.

6. The terminal module of claim 1, wherein the second terminal unit comprises second terminals each having a body portion with two ends provided with the contacting end and a connecting end, respectively, the second base enclosing the body portions of the second terminals.

7. The terminal module of claim 6, wherein the second base has a hollow-cored region from which the body portions of the second terminals are fully exposed.

8. The terminal module of claim 1, wherein two third adjoining portions are disposed at two sides of a bottom of the third base, respectively, and coupled to a top of the second base, whereas two third engaging portions are disposed at two sides of a top of the third base, respectively, and coupled to a bottom of the fourth base.

9. The terminal module of claim 1, wherein the third terminal unit comprises third terminals each having a body portion with two ends provided with the contacting end and a connecting end, respectively, the third base enclosing the body portions of the third terminals.

10. The terminal module of claim 9, wherein the third base has a hollow-cored region from which the body portions of the third terminals are fully exposed.

11. The terminal module of claim 1, wherein two fourth adjoining portions are disposed at two sides of a bottom of the fourth base, respectively, and coupled to a top of the third base.

12. The terminal module of claim 1, wherein the fourth terminal unit comprises fourth terminals each having a body portion with two ends provided with a contacting end and a connecting end, respectively, the fourth base enclosing the body portions of the fourth terminals.

13. The terminal module of claim 1, wherein the fourth terminal module further comprises a fourth ground element coupled to the fourth base so that extending portions are disposed at an edge of the fourth ground element and are in contact with the ground terminal of the fourth terminal unit.

14. An electrical connector, comprising the terminal module of claim 1 and a casing which the terminal module is disposed in.

15. The electrical connector of claim 14, wherein the casing comprises a housing and a rear lid which are coupled together to confine the terminal module to the housing, with the housing containing the terminal module.

16. The electrical connector of claim 15, wherein the housing has a receiving region containing the terminal module and has an end provided with a mouth and grooves in communication with the mouth, the grooves receiving contacting ends of the first terminals and contacting ends of the fourth terminals, and an opening in communication with the receiving region is disposed at a bottom of the housing, allowing the connecting ends of the first terminals, the connecting ends of the second terminals, the connecting ends of the third terminals, and the connecting ends of the fourth terminals to be disposed at the opening.

17. The electrical connector of claim 16, wherein channels are disposed on inner sides of two opposing sidewalls of the housing, and two fixing holes penetrate the two opposing sidewalls of the housing to communicate with the channels, respectively, with the rear lid comprising a baffle and two lateral plates flanking the baffle, wherein guide portions and hook portions are disposed on the lateral plates, respectively, with the rear lid coupled to the housing, allowing the channels to receive the guide portions and the hook portions, with the hook portions engaged with the fixing holes.

18. The electrical connector of claim 17, wherein the baffle has limiting notches, with the rear lid coupled to the housing, allowing the limiting notches to constrain the connecting ends of the fourth terminals.

19. The electrical connector of claim 18, wherein two opposing through holes are disposed on two sidewalls of the housing and positioned proximate to the opening, respectively, with a supporting plate insertedly disposed at each said through hole, allowing the connecting ends of the first terminals, the connecting ends of the second terminals, the connecting ends of the third terminals, and the connecting ends of the fourth terminals to press against the supporting plates.

* * * * *